US005514937A

United States Patent [19]

Kane et al.

[11] Patent Number: 5,514,937

[45] Date of Patent: May 7, 1996

[54] APPARATUS AND METHOD FOR COMPENSATING ELECTRON EMISSION IN A FIELD EMISSION DEVICE

[75] Inventors: Robert C. Kane, Scottsdale; Robert T. Smith, Mesa, both of Ariz.

[73] Assignee: Motorola, Schaumburg, Ill.

[21] Appl. No.: 185,347

[22] Filed: Jan. 24, 1994

[51] Int. Cl.[6] ..... G09G 3/10

[52] U.S. Cl. ..... 315/169.1; 313/308; 313/336

[58] Field of Search ..... 315/169.1, 307, 315/292, 241 R; 313/308, 336

[56] References Cited

U.S. PATENT DOCUMENTS

| | | | |
|---|---|---|---|
| 4,005,337 | 1/1977 | Rabe | 315/241 R |
| 4,075,536 | 2/1978 | Stevens | 315/241 R |
| 4,177,406 | 12/1979 | Hermeyer et al. | 315/307 |
| 4,647,830 | 3/1987 | Bees | 315/241 R |
| 5,034,662 | 7/1991 | Nishida et al. | 315/241 R |
| 5,313,140 | 5/1994 | Smith et al. | 315/169.1 |
| 5,341,069 | 8/1994 | Kosich et al. | 315/202 |

*Primary Examiner*—Robert Pascal
*Assistant Examiner*—Darius Gambino
*Attorney, Agent, or Firm*—Eugene A. Parsons

[57] ABSTRACT

An electron emission device including an array of microelectronic field emission devices, each with an integrally formed capacitance, a plurality of switches, a weighting level detector, and data storage and weighting structure. In one operational method, the field emission device electron current emission is characterized and a weighting factor is calculated and coupled into the data storage and weighting means so as to provide electron emission device electron emission current in accordance with a desired emission level as prescribed by a data input signal and notwithstanding variations in electron current emission which may be present due to device fabrication.

12 Claims, 5 Drawing Sheets

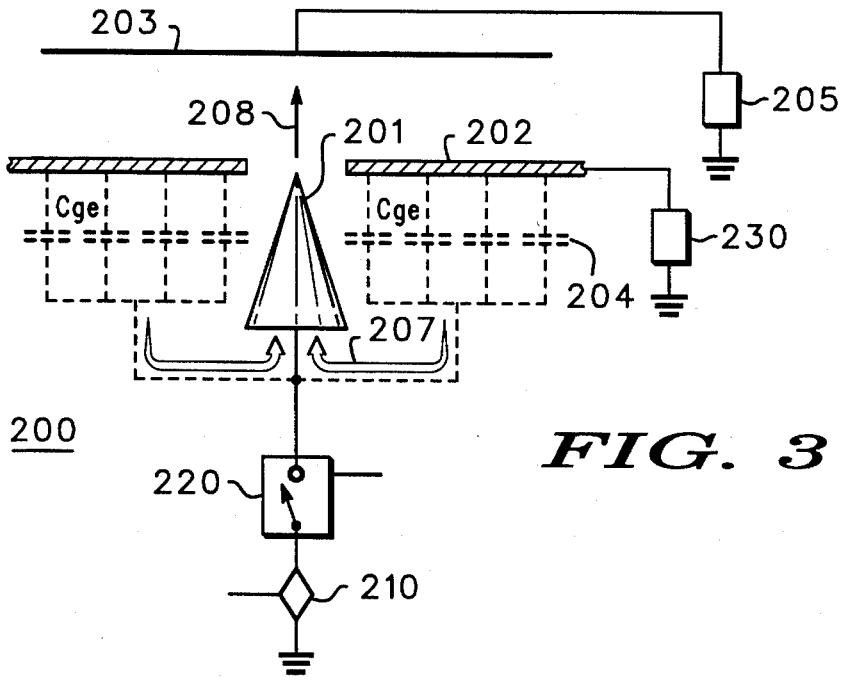
FIG. 3
FIG. 4
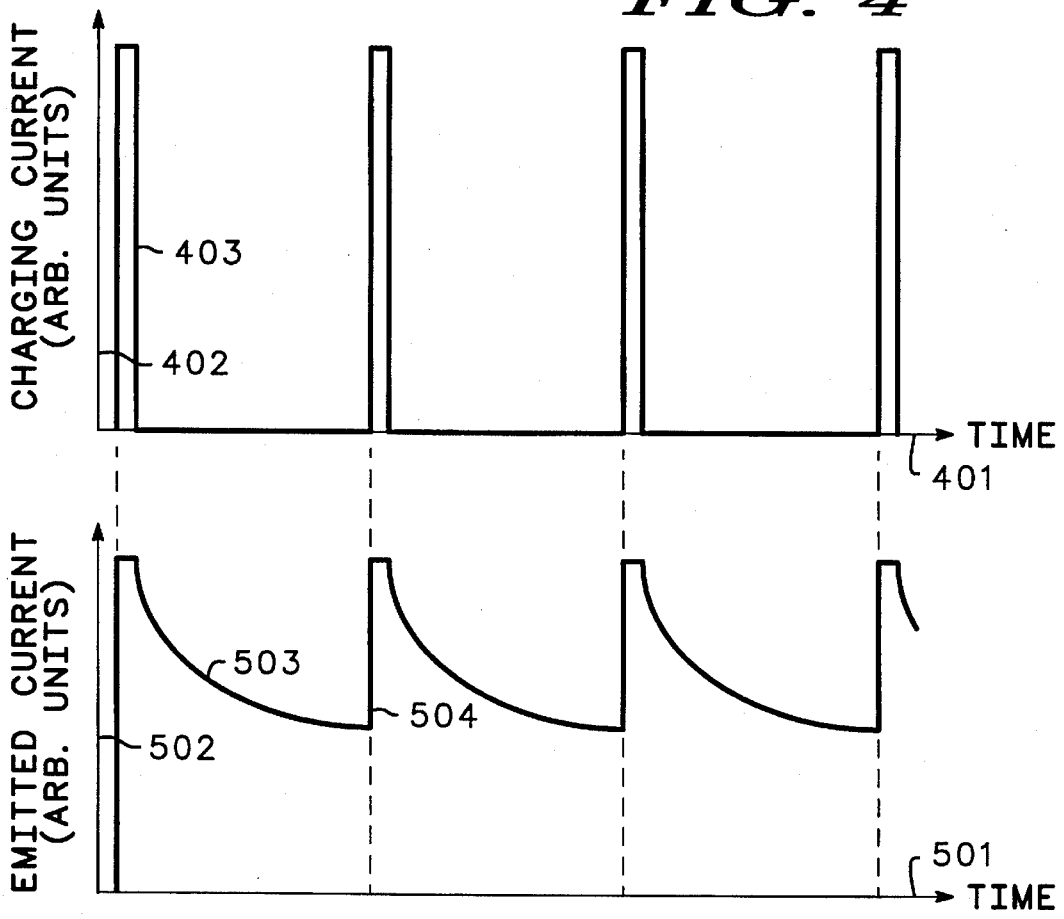
FIG. 5

APPARATUS AND METHOD FOR COMPENSATING ELECTRON EMISSION IN A FIELD EMISSION DEVICE

RELATED APPLICATION

Microelectronic field emission devices comprised of an integrally formed capacitance are described more fully in a co-pending application, now a U.S. Patent, entitled "A Field Emission Device With Integral Charge Storage Element and Method For Operation", U.S. Pat. No. 5,313,140, issued on May 17, 1994 and assigned to the same assignee.

FIELD OF THE INVENTION

This invention relates generally to field emission devices and more particularly to apparatus and methods for characterizing and controlling field emission device electron emission.

BACKGROUND OF THE INVENTION

Microelectronic field emission devices are known in the art and typically comprise an electron emitter, for emitting electrons and an extraction electrode, for providing an electric field to the electron emitter to facilitate the emission of electrons. In some embodiments, field emission devices may also include an anode for collecting emitted electrons.

Operation of field emission devices typically includes operably coupling a voltage between the extraction electrode and a reference potential and operably connecting the electron emitter to the reference potential. Alternatively, the extraction electrode may be operably connected to a reference potential and a voltage may be operably coupled between the electron emitter and the reference potential. In order to effect modulated electron emission it is possible to provide an extraction electrode potential in concert with a variable electron emitter potential. In any event, electron emission is effected and affected by the voltage which is impressed between the extraction electrode and the electron emitter.

A common problem of field emission devices is that the emission characteristics are dis-similar from one electron emitter to another. That is, for a plurality of field emission devices, each comprised of an electron emitter, the electron emission characteristics will be non-uniform.

Accordingly, there exists a need for a method which overcomes at least some of the shortcomings of the prior art.

SUMMARY OF THE INVENTION

This need and others are substantially met by provision of electron emission apparatus including a field emission device with an electron emitter and a gate extraction electrode with an integrally formed capacitance therebetween, a weighting level detector, a switch having first and second current carrying terminals and a control terminal, the first current carrying terminal of the switch being coupled to the integrally formed capacitance and the second current carrying terminal of the switch being coupled to a controllable potential source and to the weighting level detector, and data storage and weighting structure having an output coupled to the controllable potential source and an input coupled to the weighting level detector.

This need and others are further substantially met by provision of a method for compensating, limiting, and controlling electron emission in an electron emission device including the steps of providing an electron emission apparatus including a field emission device having an electron emitter and a gate extraction electrode with an integrally formed capacitance therebetween and a switch having a first terminal coupled to the integrally formed capacitance and a second terminal connected to a controllable potential source. The switch is operated to provide electron charge through the switch to the integrally formed capacitance from the controllable potential source during a charge time period. A first voltage detect operation is performed to monitor the voltage level to which the integrally formed capacitance has been charged and a wait period is provided during which electron current in the field emission device is substantially provided by charge stored in the integrally formed capacitance. A second voltage detect operation is performed to monitor the voltage level to which the charge on the integrally formed capacitance has been depleted by electron emission of the field emission device and an electron emission information calculation and weight assignment operation is performed using the information from the first and second voltage detect operations. The calculated electron emission information is then utilized to control the controllable potential source to provide a desired electron emission by the field emission device.

BRIEF DESCRIPTION OF THE DRAWINGS

FIG. 3 is a schematic representation of the field emission device of FIG. 2 depicting an emission mode.

FIG. 4 is a graphic representation of charging current vs. time in the field emission device of FIG. 2.

FIG. 5 is a graphic representation of electron emission current vs. time in the field emission device of FIG. 3.

DETAILED DESCRIPTION OF THE INVENTION

Electron emission (emitted current) in field emission devices may generally be described by the Fowler-Nordheim relation $$J=(3.84\times10^{-11}\,\mathcal{E}_F/[\varnothing+\mathcal{E}_F]^{2}\varnothing)^{1/2}\,\mathcal{E}^2 exp\{-6.83\times10^{7}\varnothing$$

$^{3/2}(0.95-[3.79\times10^{-4}\,\mathcal{E}^{1/2}/\varnothing]^2)/\,\mathcal{E}\}$ where J represents the emission in $A/m^2$ $\mathcal{E}$ is the Fermi energy level of the emitting material Ø is the surface work function of the emitting material and $\mathcal{E}$ is the electric field which is present at the emitting material surface.

The electric field, $\mathcal{E}$, may alternatively be represented as βV where β is an enhancement factor and V is the applied voltage which induces the un-enhanced field.

The enhancement factor, β, is a function of the geometry of the electron emitting structure. For present applications an electron emitter is realized with a geometric discontinuity of small radius of curvature on the order of approximately 500Å. Since the enhanced electric field is dependent on the radius of curvature of the emitter it is observed that variation in emitter radius among a group of otherwise similar electron emitters will provide for dis-similar enhanced electric fields at each emitter.

Surface work function, Ø, is dependent on the material of which the surface of the electron emitter is comprised. In applications employing microelectronic field emission devices adsorbed contaminants are present on the electron emitter surface. As such variations in adsorbates will be manifested as a variation in the surface work function of individual electron emitters within a group of electron emitters.

These variations in the material system which comprises typical field emission devices makes them unsuitable for many applications minus a method for characterizing the said variations and providing a means for compensation.

Figure 1:
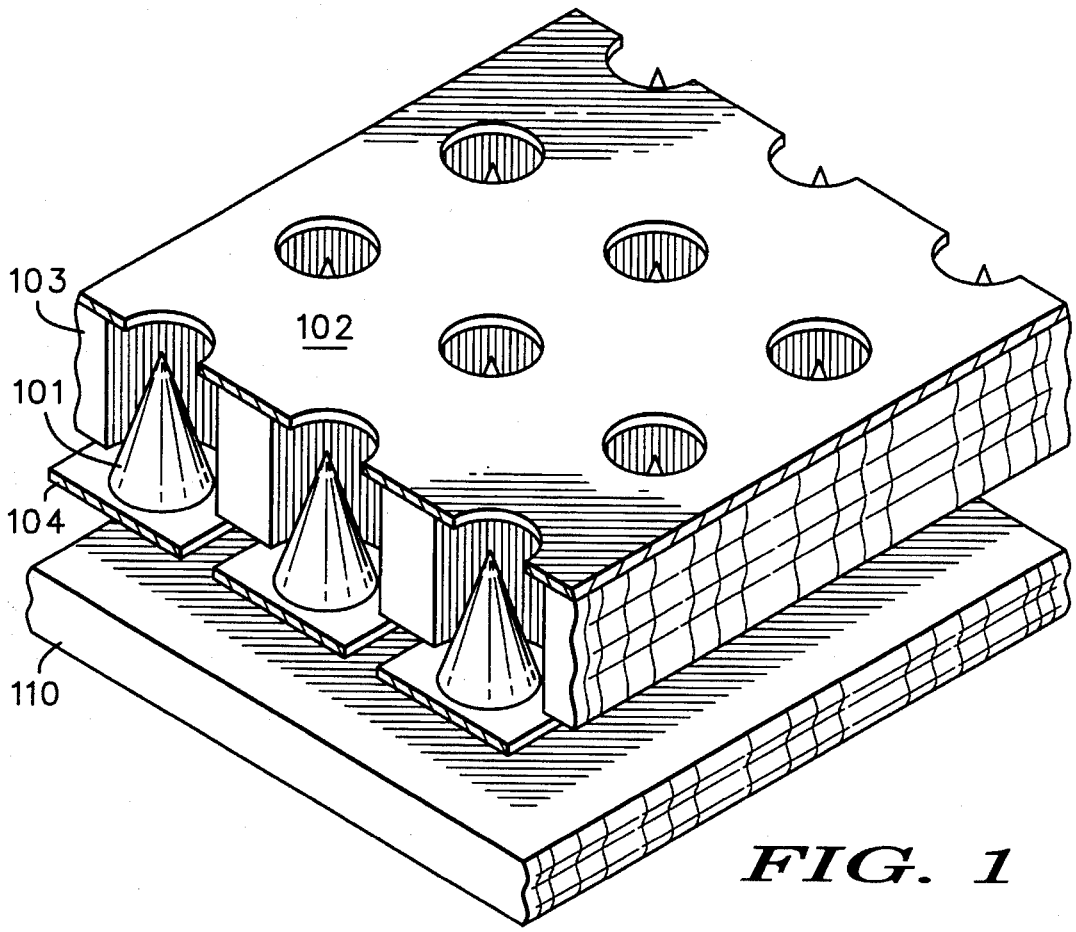
FIG. 1 is a perspective view of an embodiment of an array of field emission devices, portions thereof removed and shown in section.

FIG. 1 is a perspective view of an array of field emission devices wherein a single gate extraction electrode 102 is common to each of a plurality of electron emitters 101. Gate extraction electrode 102 is shown disposed on an insulator layer 103, which insulator layer 103 is typically realized of material having prescribed electrical properties such as relative permittivity and resistivity. FIG. 1 further depicts a plurality of conductive elements 104 each of which is operably coupled to an electron emitter 101. For clarity a supporting substrate 110, on which embodiments of field emission devices are commonly disposed, is depicted in an exploded view. However, conductive element 104 and insulator layer 103 are typically disposed on the supporting substrate. Gate extraction electrode 102 may be comprised of any of many materials which are one of metallic conductors, such as molybdenum, nickel, niobium, or tungsten, and semiconductors, such as silicon. Conductive elements 104 may also be comprised of one of conductive and semiconductor materials such as those described previously with reference to gate extraction electrode 102.

Each of the field emission devices in the array depicted in FIG. 1 includes an electron emitter 101 disposed on and operably coupled to a conductive element 104 and substantially symmetrically within an aperture 105 defined through gate extraction electrode 102 and insulator layer 103. An integrally formed capacitance is associated with each field emission device of the array of field emission devices. The integrally formed capacitance for each field emission device includes a first conductor which is extraction electrode 102 and a second conductor which includes conductive element 104 in concert with electron emitter 101 (of the field emission device) disposed thereon and operably coupled thereto. It may be observed from FIG. 1 that the integral capacitance is further defined by a portion of insulator layer 103 disposed between gate extraction electrode 102 and each conductive element 104 and a free-space region which exists between extraction electrode 102 and each electron emitter 101.

Figure 2:
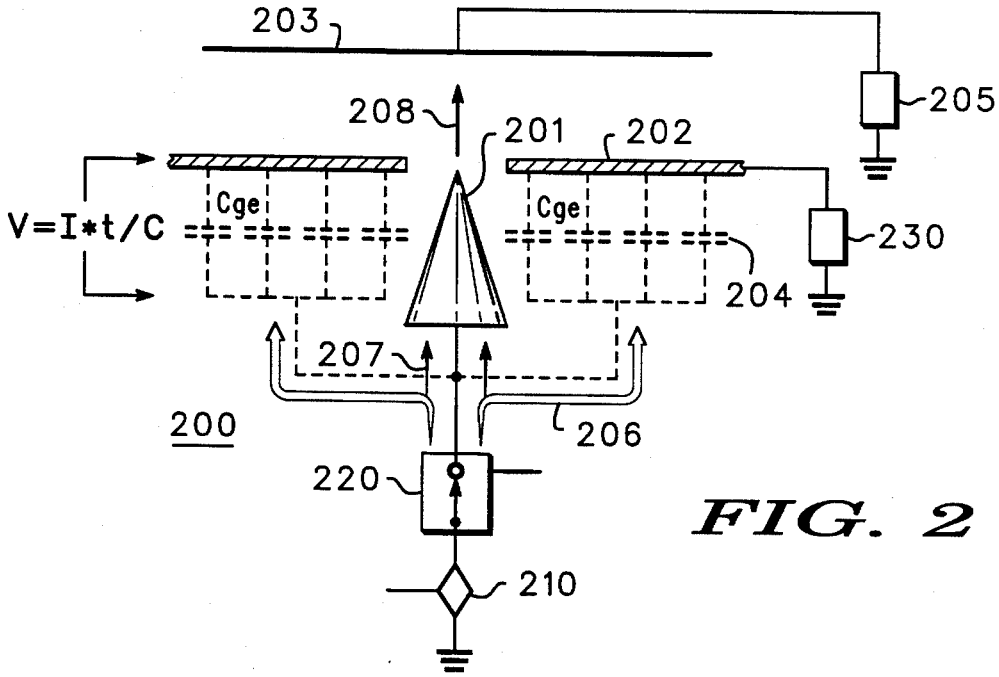
FIG. 2 is a schematic representation of an embodiment of a field emission device depicting a charging mode.

FIG. 2 is a schematic representation of a field emission device 200, generally portraying a method of operation in accordance with the present invention. Field emission device 200 includes an electron emitter 201, for emitting electrons, a gate extraction electrode 202, and a distally disposed anode 203 for collecting emitted electrons. An integrally formed capacitance 204 is depicted in dashed line form to emphasize the importance of the fact that this is not a discrete circuit element and is realized by virtue of the physical structure of the field emission device 200 (see components 101, 102, 103, 104 explained in conjunction with FIG. 1).

A first potential source 205, which is typically an externally provided voltage source, is operably coupled between anode 203 and a reference potential, such as ground. A second potential source 230, which is typically an externally provided voltage source, is shown operably coupled between gate extraction electrode 102 and the reference potential. An externally provided switch 220 is depicted in series connection between electron emitter 201 and an externally provided third potential source 210, which may be realized as, for example, one of an externally provided current source, voltage source, voltage controlled current source, and voltage controlled voltage source.

FIG. 2 further depicts a charging mode of operation which mode is identified schematically as switch 220 being in a closed (low impedance) state. For example, if switch 220 is realized as a transistor circuit the transistor circuit will generally be in an ON mode to realize the low impedance state (mode) . As such potential source 210 provides a charging electron current flow, represented by arrows 206, through switch 220 to deposit electrons onto integrally formed capacitance 204. Potential source 210 assumes a desired terminal voltage as required to deliver a pre-determined charge to integrally formed capacitance 204. As integrally formed capacitance 204 charges a voltage, described by the relationship V=Q/C (V=I*t/C), will be caused to exist between gate extraction electrode 202 and electron emitter 201.

Recall from the description of the embodiment depicted in FIG. 1 that the electron emitter may be disposed on a conductive element. For the purposes of the operational description of FIG. 2 it is assumed that electron emitter 201 also represents any conductive element (such as conductive element 104 of FIG. 1) to which electron emitter 201 may be operably coupled and which may comprise a part of the second conductor of the integrally formed capacitance 204.

Returning now to the operational description of the device of FIG. 2, it is shown that as the voltage between gate extraction electrode 202 and electron emitter 201 rises (as a result of the increasing charge on integrally formed capacitance 204) an emission current, represented by arrows 207, begins to flow into electron emitter 201 and becomes an emitted electron current, represented by arrow 208.

FIG. 3 is a schematic representation similar to FIG. 2 depicting an emission mode for field emission device 200, wherein features corresponding to those previously described in FIG. 2 are similarly referenced. Switch 220 is herein depicted in an open (high impedance) mode (state) such as that which may be realized by a transistor circuit in an OFF mode. In such mode electron emitter 202 and associated integral capacitance 204 are isolated from potential source 210. However, due to the electron charge previously stored on the second conductor of integrally formed capacitance 204 the voltage between gate extraction electrode 202 and electron emitter 201 remains. The voltage between extraction electrode 202 and electron emitter 201 provides for continued emitted electron current (arrow 208) which is supplied by the stored electron charge.

Over a finite time interval as charge is released to provide the emitted electron current (arrow 208) so too will the voltage between extraction electrode 202 and electron emitter 201 be reduced, which serves to reduce the emitted electron current (arrow 208). Therefore, as less electron charge is available (over a time interval) less is demanded.

FIG. 4 is a graphic representation of a number of arbitrary charging periods of time which may be, for example, on the order of approximately 1.0 to 10.0 μsec., described previously with reference to FIG. 2 between which finite intervals of non-charging periods of time, which may be on the order of approximately 0.1 to 100 msec., exist. An ordinate 401 represents time and an abscissa 402 represents an arbitrary charging current. A charging period 403 depicts that a charging current is provided for a determined period of time at recurring intervals.

FIG. 5 is a graphic representation of emitted electron current, described previously with reference to FIG. 3, and having a time relationship substantially corresponding to that depicted previously with reference to FIG. 4. As in FIG. 4, an ordinate 501 represents time and an abscissa 502 represents an arbitrary emitted current. A time correspondence is depicted (dashed lines) between FIGS. 4 & 5 which defines that a maximum emitted electron current 503 occurs substantially during the charging period of time 403 and that a decreasing emitted electron current 503 persists during the non-charging (non-selected) period of time which corresponds substantially to the high impedance mode (open) of switch 220 depicted in FIG. 3.

Figure 6:
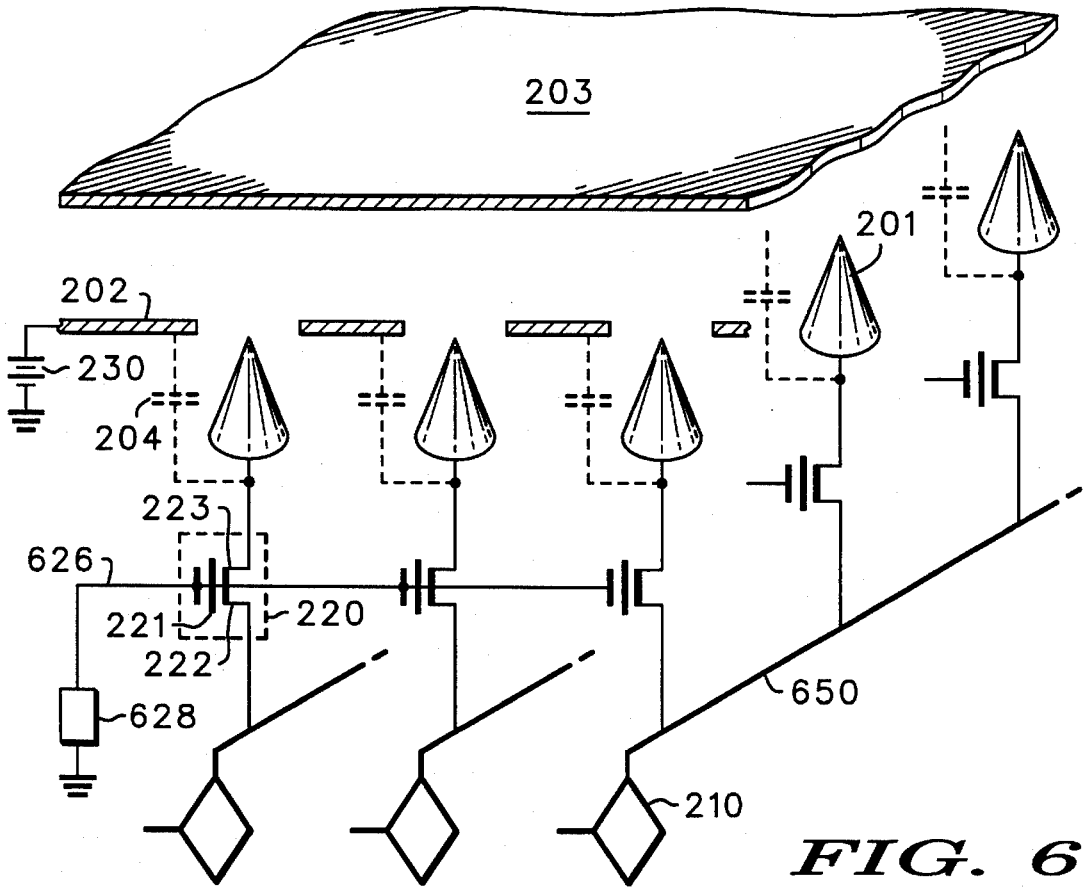
FIG. 6 is a partial schematic representation of an embodiment of an array of field emission devices.

FIG. 6 is a partial schematic representation of an array of field emission devices in accordance with the present invention as described previously with respect to FIGS. 2 & 3 and as described operationally with respect to FIGS. 4 & 5. A plurality of switches 220 (one depicted within a dashed line box), each comprised of, as an illustrative example, a transistor drain 223, a transistor source 222, and a transistor gate 221, are each serially connected between an electron emitter 201 of each field emission device 200 and a conductor line 650 of a plurality of conductive lines. Each gate 221 associated with a row of switches 220 is operably connected to a select line 626. A third potential source 628, typically comprised of an externally provided voltage source, is operably selectively connected to select line 626. When a voltage from potential source 628 is applied to select line 626, each switch 220 associated with select line 626 is placed in the low impedance mode to allow a charging current to charge the associated integrally formed capacitances 204 by virtue of potential source 210 operably coupled to each conductive line 650.

After the charge period, potential source 628 is removed to place the associated switches 220 in the high impedance mode and the operation of the row of field emission devices continues as described previously with reference to FIG. 2. A sequential progression of charging periods, by periodically sequentially applying potential source 628 to each of a plurality of rows of switches (similar to the single row illustrated), provides for substantially continuous operation (emitted current) of each of the field emission devices of the array of field emission devices.

Figure 7:
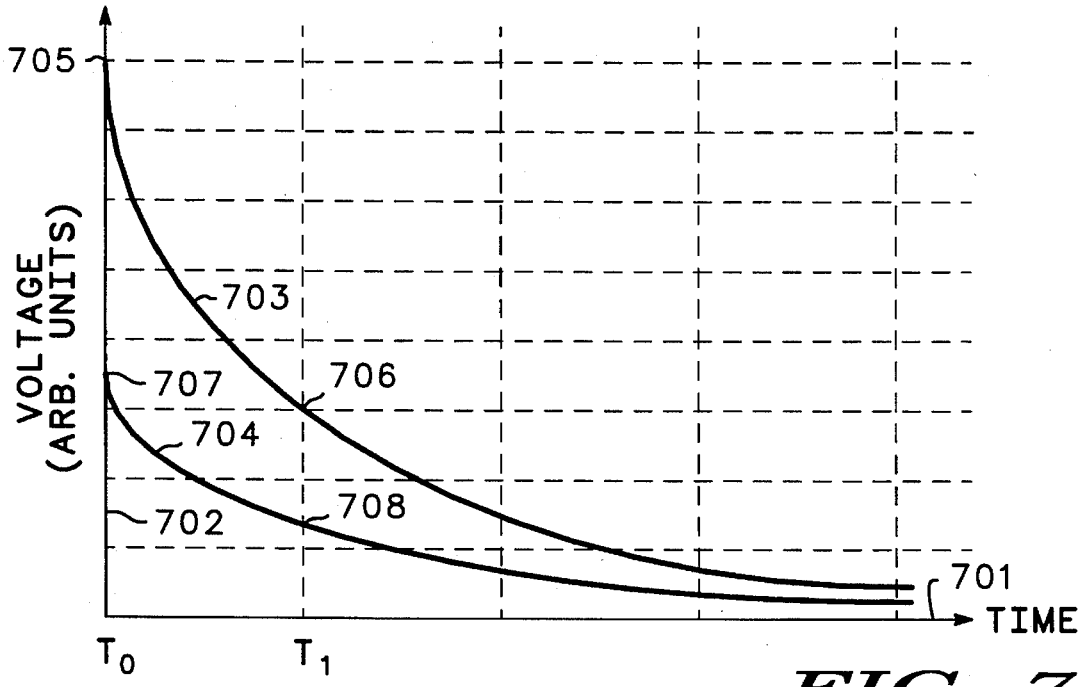
FIG. 7 is a graphic representation of characteristic voltage vs. time curves for a field emission device with integrally formed capacitance in accordance with the present invention.

Referring now to FIG. 7 there is graphically depicted a representation of voltage vs. time. An ordinate 701 is in arbitrary units of time and an abscissa 702 is in arbitrary units of voltage. A first characteristic curve 703 represents the voltage-time relationship for the integrally formed capacitance of a field emission device. A second characteristic curve 704, similarly, represents the voltage-time relationship for the integrally formed capacitance of a field emission device. That is, for an integrally formed capacitance, comprising a part of a field emission device, the emitted current will follow the Fowler-Nordheim relation and as the charge deposited on the capacitance is emitted the voltage across the capacitance will be reduced. For example, the characteristic curve 703 depicts that at a time, T0, the voltage across the capacitance is the voltage designated at 705, as a result of deposited charge. The voltage, impressed between the extraction electrode and electron emitter induces emission of electrons from the electron emitter which electrons comprise the stored charge. As a result of the continuously depleting stored electron charge the voltage across the capacitance, and hence, the extraction electrode and electron emitter also continuously decreases. At a time T1 the characteristic curve 703 corresponds to a voltage 706 which is less than the voltage at time T0. The voltage difference depicted is approximately 5 arbitrary units (in application the arbitrary units may be replaced by definite values which correspond to actual capacitance charge levels and field emission device voltage requirements). By employing the fundamental relationship C=Q/V the amount of emitted charge may be readily determined.

The second characteristic curve 704 represents the voltage-time relationship as described previously. However, it should be noted that an initial voltage 707 at time T0 is less than initial voltage 705 of first characteristic curve 703. Since the emission generally follows the Fowler-Nordheim relation, the emission is reduced and the voltage differential represented between the first and second characteristic curves 703, 704 asymptotically approaches a value at which no further significant emission takes place. It should also be noted that as a result of the reduced initial emission level, that for the same time interval considered when describing the voltage variation of characteristic curve 703 the voltage at time T1 is reduced approximately 2.2 arbitrary units from that which was present at time T0. As a result of the substantially linear relationship between charge and voltage for a given capacitance, it is shown that the emitted charge (electron emission) for a field emission device may be determined by calculating the difference of the voltages across the capacitance which provides the charge to be emitted. Further, since the total emitted current is a function of the initial voltage it is possible to control the emitted charge as desired by determining a desired initial voltage to which the capacitance will be charged.

In many applications it is desired to have knowledge of aggregate emitted charge over a time interval and to be able to control the emitted charge in the sense that the emitted charge will be accurately determined.

Figure 8:
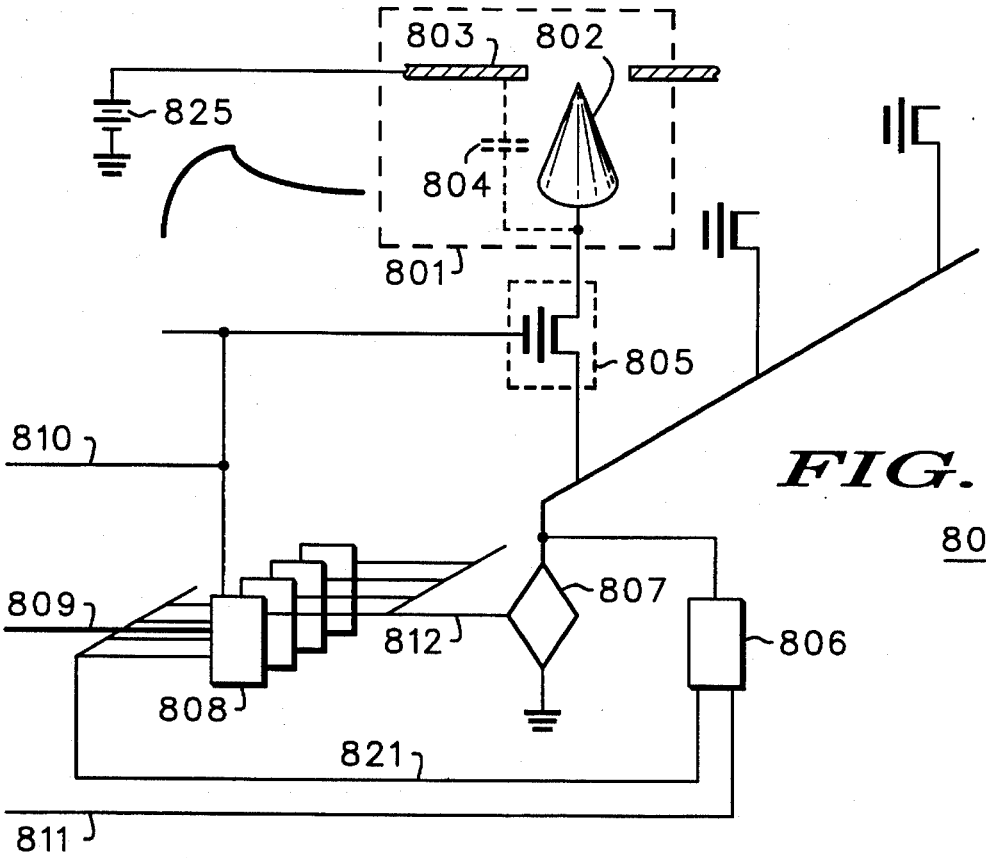
FIG. 8 is a schematic representation of one embodiment of a field emission device with attendant emission control and weighting structure in accordance with the present invention.

FIG. 8 is a schematic representation of an embodiment of electron emission apparatus 800 employing a current control and characterization circuit for use with a field emission device 801 (delineated within a dashed line box). Field emission device 801 includes an electron emitter 802, a gate extraction electrode 803 and a distally disposed anode (not shown) and utilizes an integrally formed capacitance 804 as a charge storage element.

A gate extraction voltage is provided by an externally provided voltage source 825 operably coupled between gate extraction electrode 803 and a reference potential such as ground. A switch 805 is serially connected between integrally formed capacitance 804, a potential source 807, and a weighting level detector 806. A select line 810 is operably coupled to switch 805 and a data storage and weighting structure 808. Data storage and weighting structure 808 can be, for example, any convenient logic circuitry, gate array, etc. and associated addressable storage structure, such as a random access memory (RAM), EPROM, EEPROM, etc. capable of storing an appropriate enable signal for the specific potential source 807, or a microprocessor, or similar structure. During a charging period of time, switch 805 operates in a low-impedance (ON) mode to provide a path through which a charge (electrons), supplied by potential source 807, is deposited on integrally formed capacitance 804. Potential source 807 is enabled via an enable signal impressed on (or removed from) a source enable line 812 which is coupled between potential source 807 and the data storage and weighting structure 808. At a time prior to the end of the charging time, at which time the voltage across the integral capacitance 804 has reached a maximum charged voltage, weighting level detector 806 is placed in an ON mode by a signal applied to a weight factor enable line 811. Weighting level detector 806 detects the maximum charged voltage by any of many known techniques such as, for example, by applying the voltage to a field effect transistor. Subsequently, switch 805 is placed in a high impedance (OFF) mode to effectively remove potential source 807 and weighting level detector 806 from coupling to field emission device 801. During a desired time period field emission device 801 continues to provide electron emission in accordance with the charged voltage of integrally formed capacitance 804 as prescribed by the Fowler-Nordheim relation. As described in detail above, the emission is substantially comprised of the stored charge on integrally formed capacitance 804.

At a later time, corresponding to a desired time interval, weighted level detector 806 again is placed in an ON mode by application of a suitable signal to weight factor enable line 811 and switch 805 is placed in the ON mode. Weighting level detector 806 then detects the voltage across integrally formed capacitor 804. Electron emission information is determined by calculating the variation (difference) of the two measured voltages and is provided to data storage and weighting structure 808 via an interconnect line 821, coupled between weighting level detector 806 and data storage and weighting structure 808.

In application a control signal corresponding to a desired field emission device emission level is provided on a data input line 809, which is coupled to data storage and weighting structure 808. The control signal is processed within data storage and weighting structure 808 to provide the enable signal, of appropriate amplitude, to compensate (signal weighting) for any emission variations of the associated field emission device 801 and the resultant enable signal is placed on enable line 812 to control the output of potential source 807.

One mode of operation of the weighted level detect method is to determine the emission characteristics of any field emission device electron emitter by utilizing the voltage variation over a time interval according to the relationship, $[V(T0)-V(T1)]*C=Q$. By initializing the field emission device at a predetermined voltage of integrally formed capacitance 804 and determining the total charge emitted over an interval, a weighting factor may be calculated within data storage and weighting structure 808 to be subsequently employed to modify an enable signal for potential source 807 whenever the enable signal is placed on enable line 812.

For the purposes of example only, it may be found that by initially allowing integrally formed capacitance 804 to charge to a maximum voltage of 100 V, during an emission time period the voltage is reduced to 60 V. Given an integral capacitance of, for this example, 2 pF, this voltage variation indicates emission of $8\times10^{-11}$ coulombs of electrons. If the electron emission in this example is other than that which is preferred, then the weighting function will be invoked to modify subsequent enable signals placed on enable line 812 to reduce (increase) the maximum or initial charged voltage of integrally formed capacitance 804 so as to bring the emission to the desired level.

Figure 9:
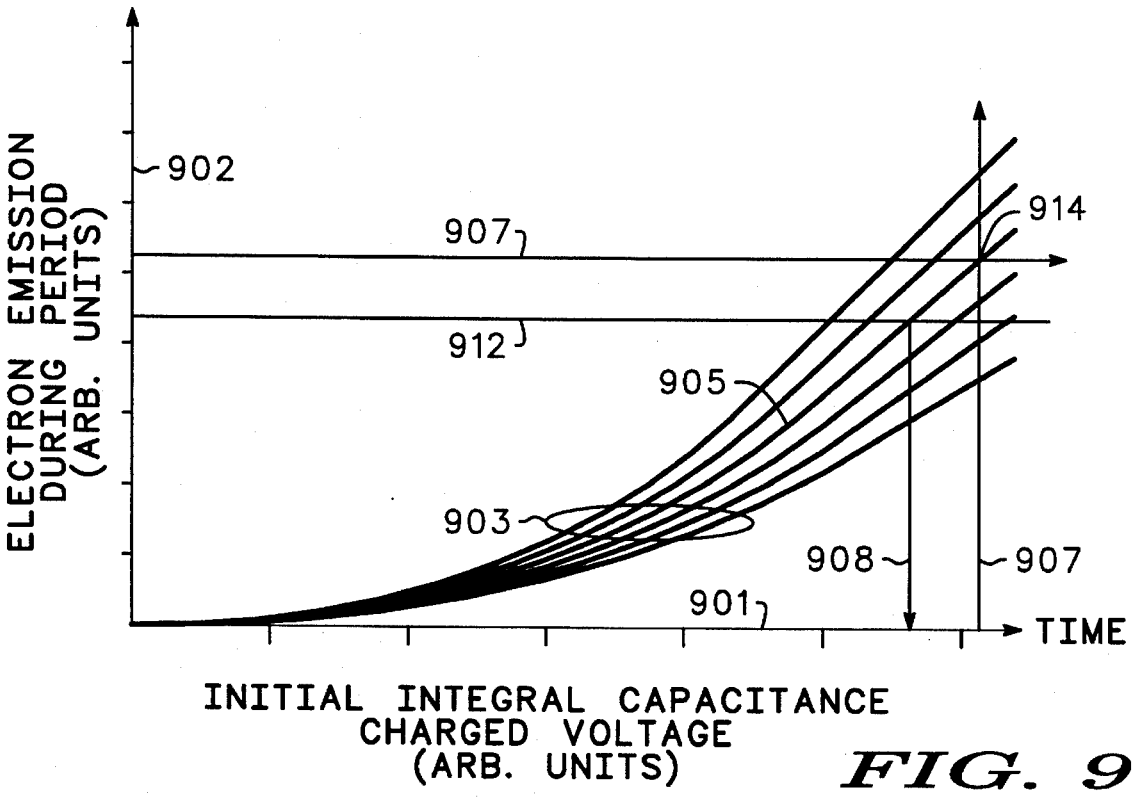
FIG. 9 is a graphic representation of a family of characteristic curves depicting aggregate emitted charge over a time period as a function of initial charged voltage as employed in accordance with the present invention.

FIG. 9 depicts, graphically, and in arbitrary units, the relationship between electron emission current over a period of time to an initial charged voltage of an integrally formed capacitance of a field emission device. An ordinate 901 and associated abscissa 902 express the initial charged voltage of an integrally formed capacitance and the electron emission after a time period, respectively. A family of characteristic curves 903 defines the general relationship between aggregate electron emission (after the period) and the initial integral capacitance charged voltage. Utilizing charge (electron) emission information, such as that determined by the example above, and with knowledge of the initial voltage (V(T0) in the example) it is possible to define a point 914 on one characteristic curve 905 which satisfies the requirement of representing both a selected initial charged voltage 906 and a selected electron emission 907 during the period. A preferred electron emission, represented by a line 912, intersects the identified desired characteristic curve 905 of the family of curves 903 and corresponds to a preferred voltage 908 which is required for proper emission for the emission characteristics of the field emission device under consideration.

Figure 10:
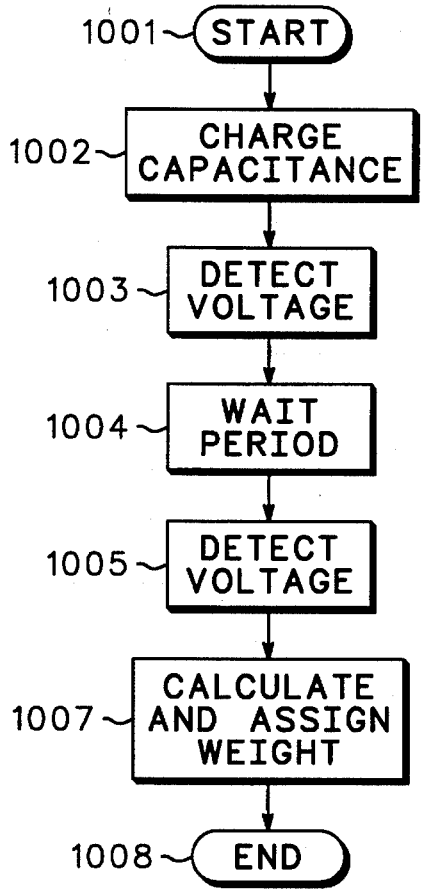
FIG. 10 is a flowchart representation of one implementation of the emission control and weighting function in accordance with the present invention.

A flowchart representation of one possible method for compensating, limiting, and controlling electron emission in an electron emission apparatus in accordance with the present invention is illustrated in FIG. 10. A sequence (method) is initiated at a start time 1001 by providing the various signals to the various lines 809, 810, 811, 812, 821 to activate electron emission apparatus 800 as described previously with reference to FIG. 8. A capacitance charge operation 1002 follows during which time period electron charge is provided from potential source 807 to integrally formed capacitance 804. Near the end of the time period of charge operation 1002 a first detect voltage operation 1003 is performed. A wait period operation 1004 corresponds to a time period during which electron emission occurs in the field emission device and is substantially comprised of integrally formed capacitance 804 stored charge and in the absence of charging. Subsequent to wait period operation 1004 a second detect voltage operation 1005 is performed. An emission calculation and weight assignment operation 1007 provides data to data storage and weighting structure 808, as described previously with reference to FIG. 8, and the sequence passes to the end 1008.

In some applications it may be desirable to perform the weighting function over a number of iterations. For example, if a first detection of the emission level determines excess emission, a weighting factor may be assigned and reside in data storage and weighting structure 808. A subsequent iteration refines the first weighting assignment and provides a more accurate weighting factor to replace the first.

Figure 11:
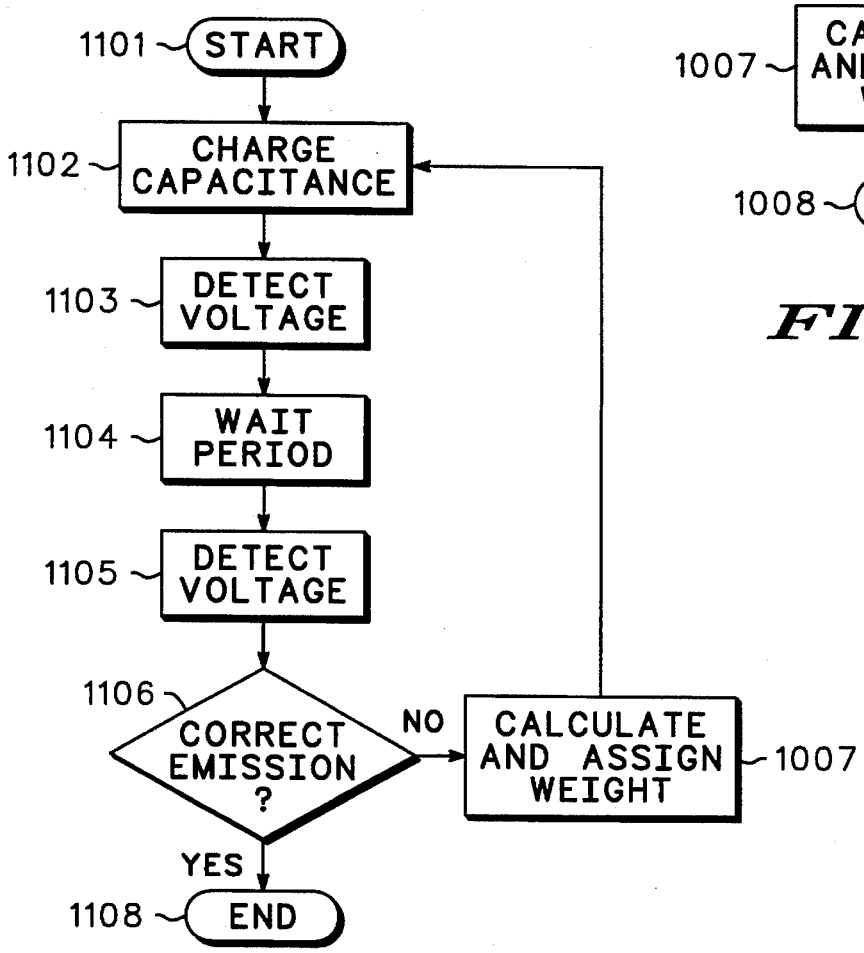
FIG. 11 is a flowchart representation of another implementation of the emission control and weighting function in accordance with the present invention.

FIG. 11 provides a flowchart representation of another possible method for compensating, limiting, and controlling electron emission in an electron emission apparatus in accordance with the present invention. The sequence (method) is initiated at a start block 1101 by providing the various signals to the various lines to activate the means as described previously with reference to FIG. 8. A capacitance charge operation 1102 follows, after which a first detect voltage operation 1103 is performed. A wait period operation 1104 corresponds to the period during which emission occurs in the absence of charging. Subsequent to the wait period operation 1104, a second detect voltage operation 1105 is performed. An emission calculation and decision operation 1106 is performed. If the emission is correct, the sequence passes to the end block 1108. If the emission is not correct, the sequence passes to a weight calculation and assignment operation 1107 and subsequently returns to the charge capacitance operation 1102 for a next iteration. The sequence may be terminated as desired by passing through the loop a maximum number of times or by yielding an acceptable emission level.

In one anticipated application the weighting function is performed at the time when the electron emission apparatus is initialized such as, for example, at turn on. At that time a weighting function method is performed and weighting information is provided to and stored in the data storage and weighting means. During continued apparatus operation the weighting determining method is not performed as the weighting information remains available in the data storage and weighting means.

Accordingly, a method is disclosed for controlling field emission devices with emission characteristics which are dis-similar from one electron emitter to another. That is, for a plurality of field emission devices, each comprised of an electron emitter, the electron emission characteristics are non-uniform but the emission is controlled so as to be substantially as required.

What is claimed is:

1. Electron emission apparatus comprising:

a field emission device including
an electron emitter,
a gate extraction electrode, and
an integrally formed capacitance;

a weighting level detector;

a switch having first and second current carrying terminals and a control terminal, the first current carrying terminal of the switch being coupled to the integrally formed capacitance and the second current carrying terminal of the switch being coupled to a controllable potential source and to the weighting level detector; and data storage and weighting structure having an output coupled to the controllable potential source and an input coupled to the weighting level detector.

2. Electron emission apparatus as claimed in claim 1 wherein the weighting level detector includes a transistor.

3. Electron emission apparatus as claimed in claim 1 further comprised of:

a select line operably coupled to the control terminal of the switch;

a weight factor enable line operably coupled to the weighting level detector;

a data input line, for receiving a signal, operably coupled to the data storage and weighting structure; and a potential source enable line operably coupled to control the potential source and to receive control signals from the data storage and weighting structure.

4. Electron emission apparatus as claimed in claim 3 further comprised of an externally provided voltage source operably connected between the gate extraction electrode and a reference potential.

5. Electron emission apparatus comprising:

an array of field emission devices each including an electron emitter, a gate extraction electrode, and an integrally formed capacitance therebetween;

a weighting level detector;

a plurality of switches each having first and second current carrying terminals and a control terminal, the first current carrying terminal of each of the switches being coupled to the integrally formed capacitance of a different one of the array of field emission devices and the second current carrying terminal of each of the switches being coupled to a controllable potential source and to the weighting level detector; and data storage and weighting structure having an output coupled to the controllable potential source and an input coupled to the weighting level detector.

6. Electron emission apparatus as claimed in claim 5 wherein the array of field emission devices is arranged in a plurality of rows and columns and the apparatus further includes a weighting level detector for each row and the data storage and weighting structure has a plurality of outputs, one for each weighting level detector.

7. A method for compensating, limiting, and controlling electron emission in an electron emission device including the steps of:

providing an electron emission apparatus including a field emission device having an electron emitter and a gate extraction electrode with an integrally formed capacitance therebetween and a switch having a first terminal coupled to the integrally formed capacitance and a second terminal connected to a controllable potential source;

operating the switch to provide electron charge through the switch to the integrally formed capacitance from the controllable potential source during a charge time period;

performing a first voltage detect operation to monitor the voltage level to which the integrally formed capacitance has been charged;

performing a wait period during which electron current in the field emission device is substantially provided by charge stored in the integrally formed capacitance;

performing a second voltage detect operation to monitor the voltage level to which the charge on the integrally formed capacitance has been depleted by electron emission of the field emission device;

performing an electron emission information calculation and weight assignment operation; and utilizing the electron emission information to control the controllable potential source to provide a desired electron emission by the field emission device.

8. A method for compensating, limiting, and controlling electron emission in an electron emission device as claimed in claim 7 wherein the step of utilizing the electron emission information includes determining the emission characteristics of the field emission device by utilizing the voltage variation between the first and second voltage detect operations according to the relationship $[V(T0)-V(T1)]*C=Q$.

9. A method for compensating, limiting, and controlling electron emission in an electron emission device as claimed in claim 8 wherein the step of utilizing the electron emission information further includes calculating a weighting factor from the determined emission characteristics.

10. A method for compensating, limiting, and controlling electron emission in an electron emission device as claimed in claim 9 wherein the step of utilizing the electron emission information includes providing data storage and weighting structure coupled through a potential source enable line to a control input of the potential source and inputting the calculated weighting factor into the data storage and weighting structure.

11. A method for compensating, limiting, and controlling electron emission in an electron emission device including the steps of:

providing an electron emission apparatus including a field emission device having an electron emitter and a gate extraction electrode with an integrally formed capacitance therebetween, a switch having a first terminal coupled to the integrally formed capacitance and a second terminal connected to a controllable potential source and to an input of a weighting level detector, and data storage and weighting structure having a data input line coupled thereto, an input line from the data storage and weighting structure and a potential source enable line operably coupled to a control input of the potential source;

providing electron charge to the integrally formed capacitance during a charge time period;

performing a first voltage detect operation to monitor the voltage level to which the integrally formed capacitance has been charged;

performing a wait period during which electron current in the field emission device is substantially provided by integrally formed capacitance stored charge;

performing a second voltage detect operation;

performing an electron emission information calculation and weight assignment operation; and providing the calculated electron emission information to the data storage and weighting structure.

12. A method for compensating, limiting, and controlling electron emission in an electron emission device including the sequential steps of:

providing an electron emission apparatus including a field emission device having an electron emitter and a gate extraction electrode with an integrally formed capacitance therebetween, a switch having a first terminal coupled to the integrally formed capacitance and a second terminal coupled to a controllable potential source and a weighting level detector, a select line operably coupled to the switch, a weight factor enable line operably coupled to the weighting level detector, a data storage and weighting structure, a data input line coupled to the data storage and weighting structure and a potential source enable line coupling the potential source to an output of the data storage and weighting structure;

providing signals to at least some of the select, weight factor enable, data input and potential source enable lines of the various lines at a start time;

providing electron charge to the integrally formed capacitance during a charge time period;

performing a first voltage detect operation to monitor the voltage level to which the integrally formed capacitance has been charged;

performing a wait period during which electron current in the field emission device is substantially provided by integrally formed capacitance stored charge;

performing a second detect voltage operation;

performing an emission calculation and decision operation to determine if the emission is correct and exiting the method sequence if emission is correct; and providing electron emission information to the data storage and weighting means and repeat the sequence beginning with step B above.

* * * * *